US008117685B2

(12) United States Patent
Escobar et al.

(10) Patent No.: US 8,117,685 B2
(45) **Date of Patent: *Feb. 21, 2012**

(54) FLEXIBLE SINK STRAINER

(75) Inventors: Juan Escobar, New York, NY (US); Troy Phipps, Brooklyn, NY (US); John Kiechel, San Francisco, CA (US); Paul Katz, New York, NY (US)

(73) Assignee: Helen of Troy Limited, St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 12/903,811

(22) Filed: Oct. 13, 2010

(65) Prior Publication Data

US 2011/0023220 A1 Feb. 3, 2011

Related U.S. Application Data

(63) Continuation of application No. 11/545,747, filed on Oct. 10, 2006, now Pat. No. 7,832,027.

(51) Int. Cl.
*E03C 1/26* (2006.01)

(52) U.S. Cl. ..... 4/290; 4/286

(58) Field of Classification Search ..... 4/286, 290
See application file for complete search history.

(56) References Cited

U.S. PATENT DOCUMENTS 6,418,568 B1 * 7/2002 Briggs et al. ..... 4/287

* cited by examiner

*Primary Examiner* — Gregory Huson
*Assistant Examiner* — Karen L Younkins

(57) ABSTRACT

A flexible sink strainer having a cupped body completely comprised of a flexible material including a plurality of apertures to allow fluid to pass therethrough, wherein the body is capable of attaining first and second configurations, the first configuration being suitable for capturing material entrained within fluid as it passes through the apertures and the second configuration being suitable for removing material captured on the body as fluid passes through the apertures, is disclosed.

23 Claims, 9 Drawing Sheets

FLEXIBLE SINK STRAINER

CROSS REFERENCE TO RELATED APPLICATIONS

This is a continuation of U.S. patent application Ser. No. 11/545,747 which was file on Oct. 10, 2006 and which is incorporated herein by reference in its entirety.

TECHNICAL FIELD OF THE INVENTION

The present device relates to sink strainers. Particularly, the present device relates to flexible sink strainers.

BACKGROUND OF THE INVENTION

Sink strainers come in a variety of sizes and designs. Typical strainers comprise metal spherical center portions having a plurality of openings for the passage of water while blocking clog-causing solid particles from a homes drain. Sometimes the strainer may include a stopper portion which allows the strainer to be "closed" to water passage. These devices are known in the art as stopper/strainers. Conversely, strainers are only suitable for straining particles from a flowing water stream.

Accordingly, strainers must be capable of being cleaned of such particles, easily and frequently. Further, due to the nature of some particles, the strainer must be capable of being cleaned from both sides of the strainer. Stopper/strainers, by their very nature, are impeded on one side by the stopper portion. Frequently, matter can become entrained in the strainer portion and stopper portion.

Similarly with strainers, as the strainer portion is concave on one surface, removal of entrained material from that surface can be difficult. Should the entrained debris build-up during use of the strainer, it can degrade the effectiveness of the strainer to allow the passage of water.

The present invention solves this and other problems associated with prior art strainers and stopper/strainers.

SUMMARY OF THE INVENTION

There is disclosed herein several embodiments of an improved strainer which avoids the disadvantages of prior devices while affording additional structural and operating advantages.

In one embodiment of the invention a sink strainer comprises a cupped body completely comprised of a flexible material having a plurality of apertures to allow fluid to pass therethrough, wherein the body is capable of attaining first and second configurations, the first configuration being suitable for capturing material entrained within fluid as it passes through the apertures and the second configuration being suitable for removing material captured on the body as fluid passes through the apertures.

It is an aspect of the present invention that the second configuration is an inverted form of the first configuration.

It is another aspect of the invention that an embodiment of the sink strainer further comprise a post affixed to the cupped body for facilitating movement between the first and second configurations. The post may be comprised of a flexible material, such as an elastomeric material.

It is still another aspect of an embodiment of the invention to provide a flange affixed along a periphery of the cupped body. The flange may be comprised of a rigid material, such as a metal or plastic, or a flexible material, such as an elastomer. The flexible material of the body, the post, and the flange may be the same or different materials.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
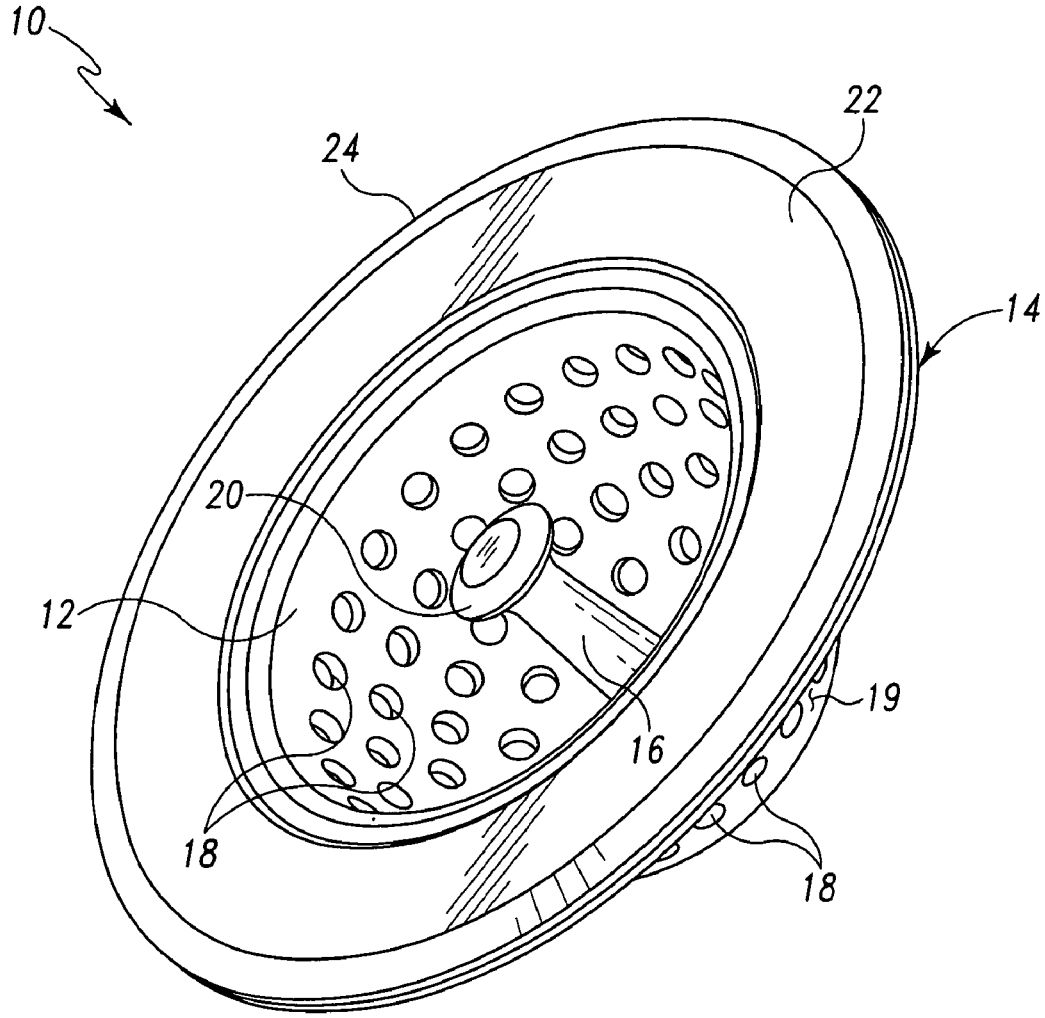
FIG. 1 is a perspective view of one embodiment of the sink strainer of the present invention.
Figure 2:
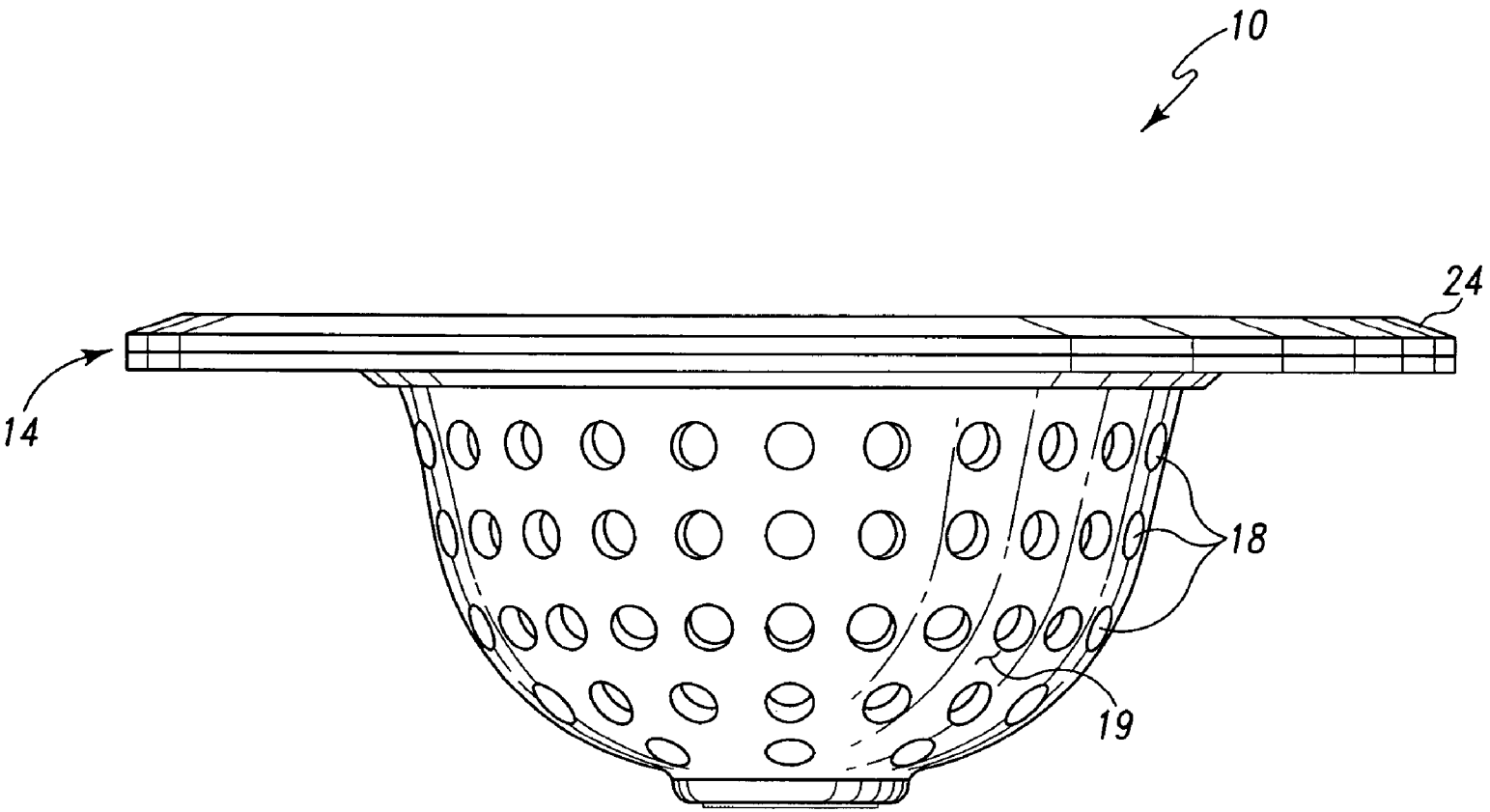
FIG. 2 is a side view of the embodiment shown in FIG. 1.
Figure 3:
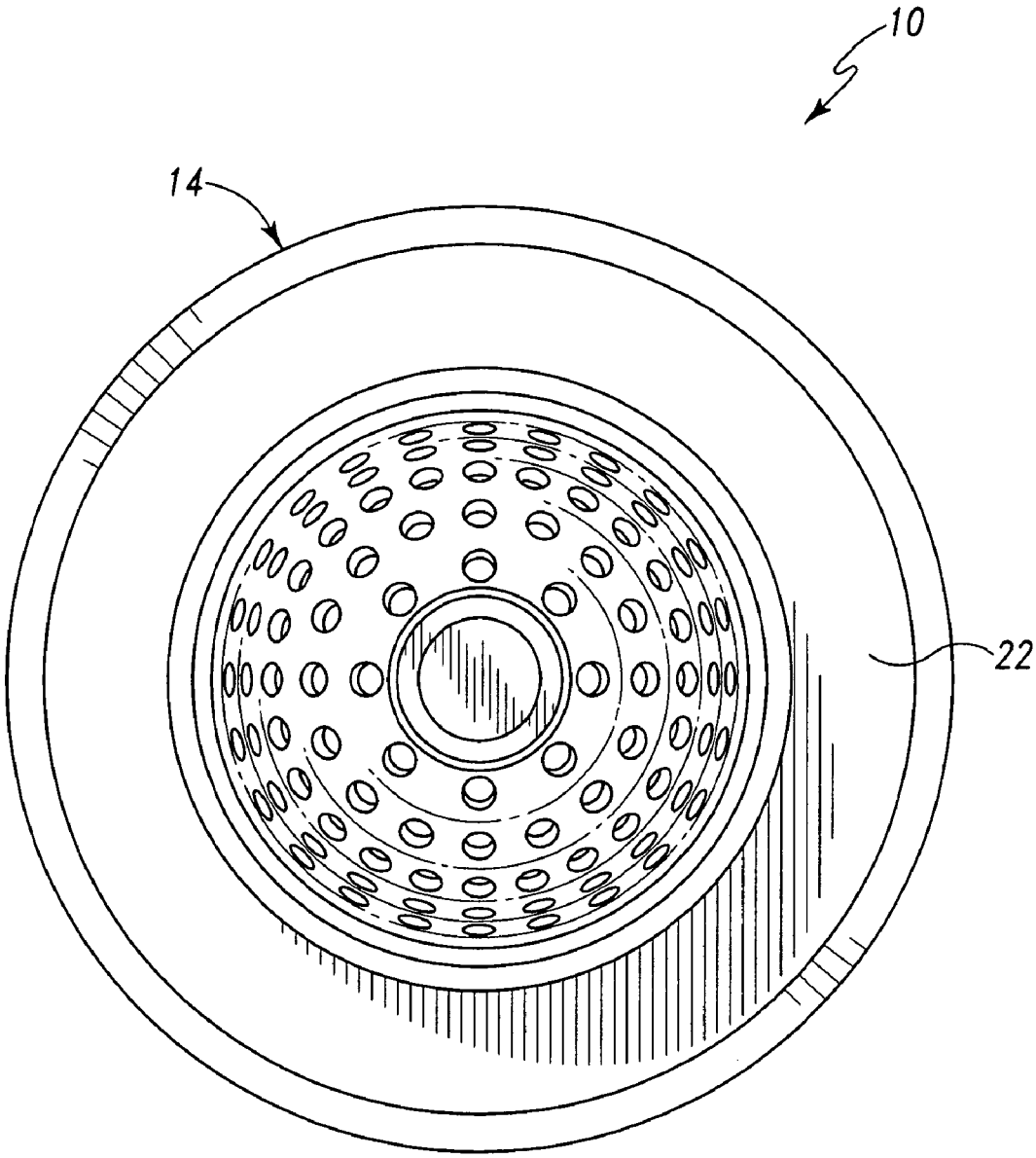
FIG. 3 is a bottom view of the embodiment shown in FIG. 1.
Figure 4:
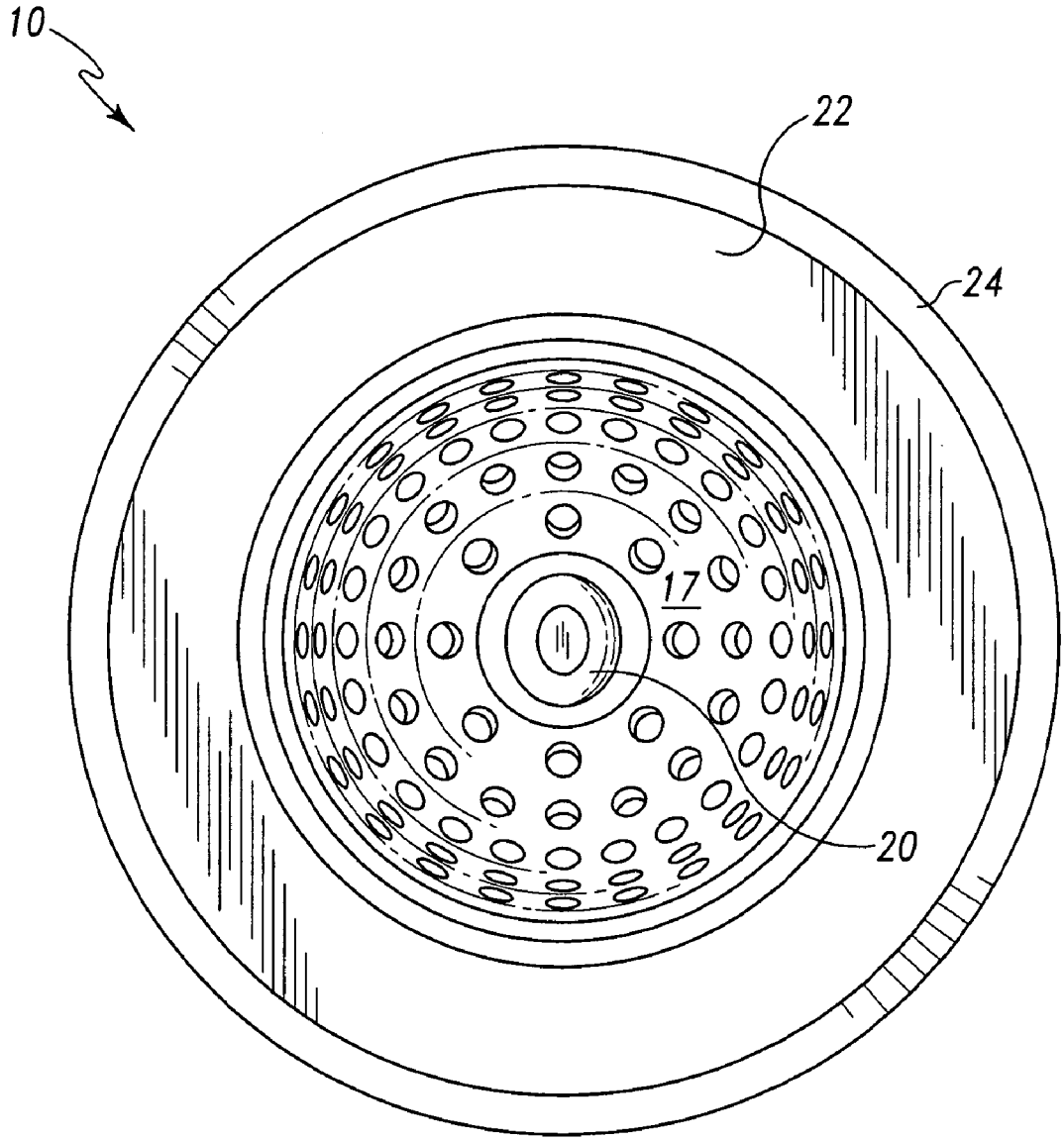
FIG. 4 is a top view of the embodiment shown in FIG. 1.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIGS. 1-9, there is illustrated several embodiments of a sink strainer, generally designated by the numeral 10. The strainer 10 of the embodiment shown in FIGS. 1-5 includes a strainer portion 12 having a cupped configuration defined by first and second opposing surfaces 17, 19, respectively, an annular flange 14, and a center post 16.

Figure 5:
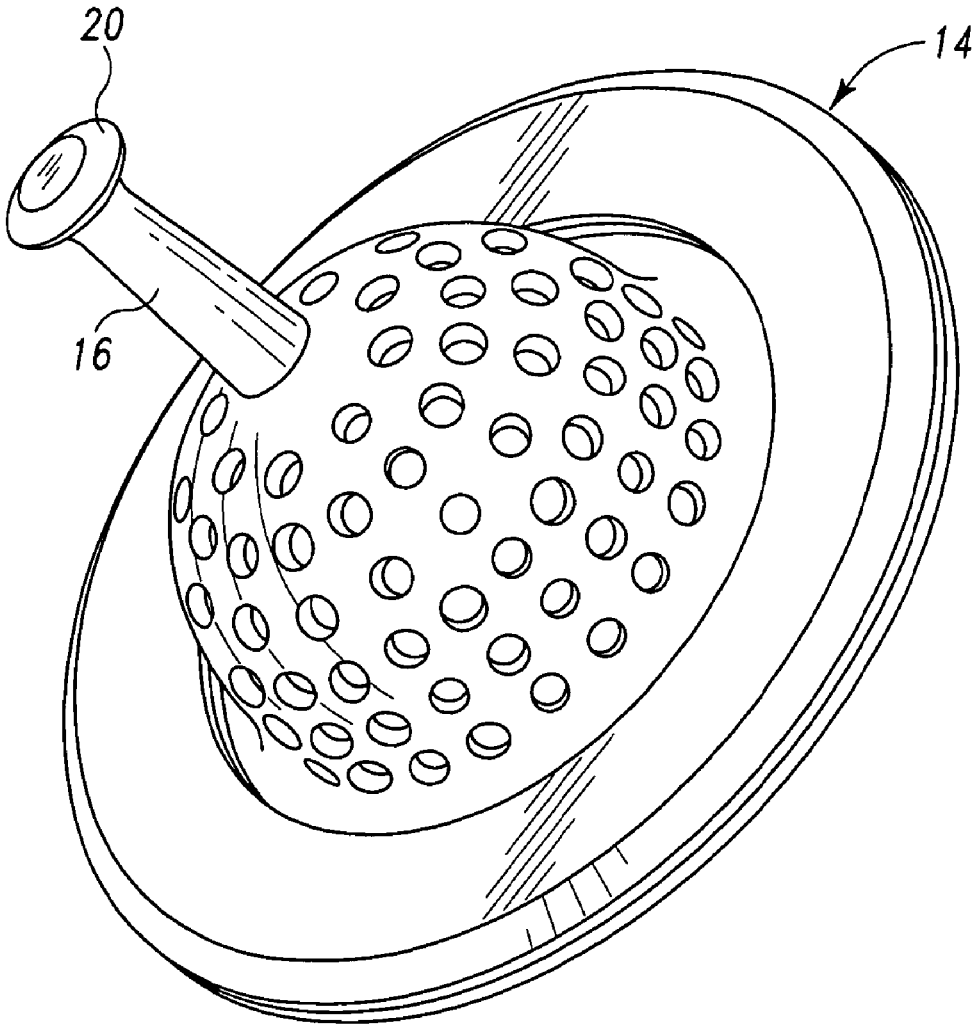
FIG. 5 is a perspective view of the embodiment shown in FIG. 1, illustrated in an inverted position.

The strainer portion 12 is comprised of a plurality of apertures 18 sized to allow liquid, such as water, to flow through the openings while trapping solid material, such as food waste, against the first surface 17. The apertures 18 may be of equal or varied size, and may be of any desired shape, such as, for example, slots, circles, triangles, combinations and the like. The strainer portion 12 is comprised of a flexible material to allow inversion of the cupped configuration, as shown in FIG. 5. The material is preferably elastomeric, including natural and synthetic materials.

As shown in FIGS. 1 and 5, the post 16 is positioned at and attached to the center of the first surface 17. The post 16 is configured to extend a suitable distance from the first surface 17 to permit access even with considerable waste build-up. The top 20 is gently flared to facilitate a positive grip of the post 16 when wet. Further, though the post 16 may be made from any number of materials, it is preferably comprised of a rigid material, such as a thermoplastic, a thermoset plastic, a metal, or any other suitable rigid material. Alternatively, the post 16 may be comprised of a flexible material identical to that of the strainer portion 12. Such a configuration may provide greater ease of manufacture, especially where the two components are unitary.

As still another alternative, other suitable configurations are possible to achieve the stated objectives. For example, the purpose of the post may be achieved through use of a ring, tab, or a similar protrusion from the first surface 17. Each of these different configurations (not shown) has benefits and advantages which would be understood by those skilled in the art.

Figure 6:
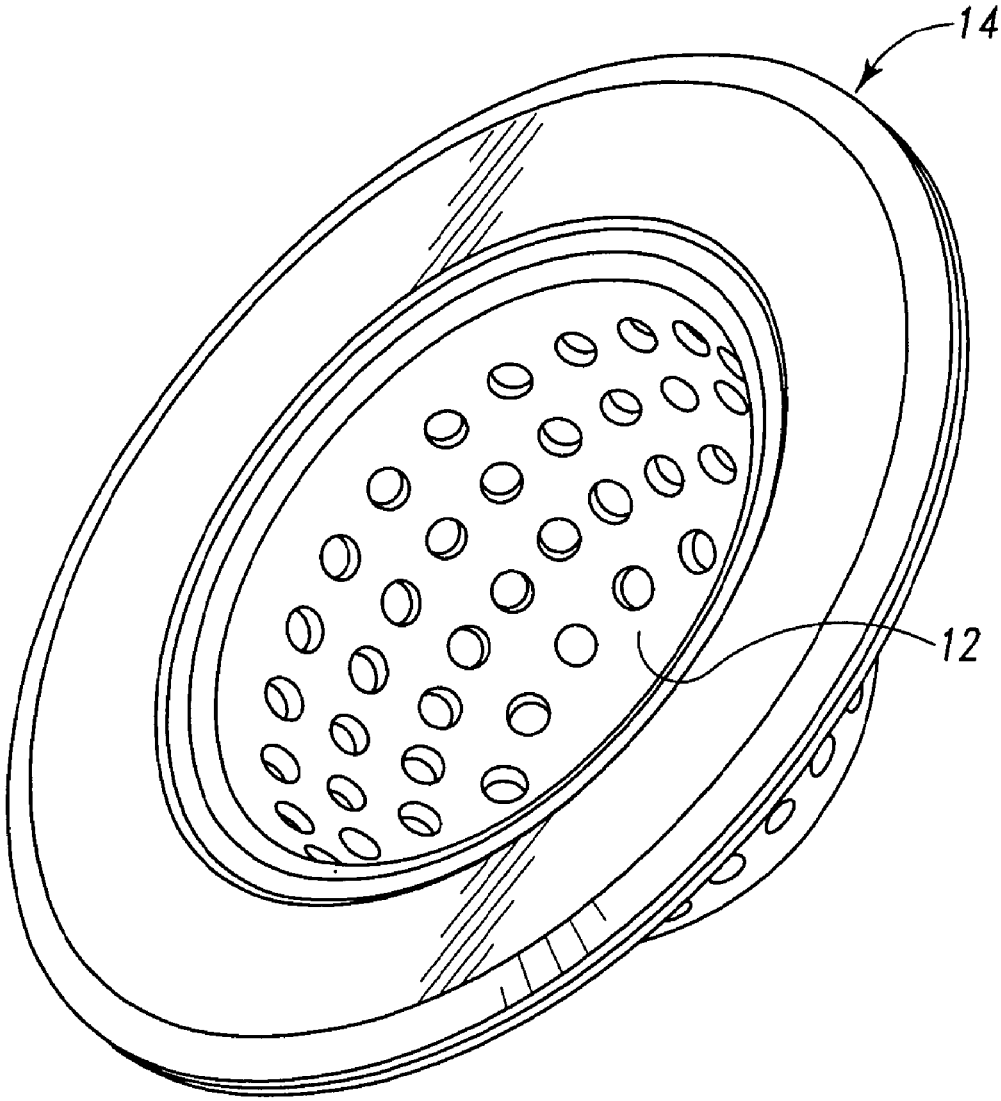
FIG. 6 is a perspective view of a second embodiment of the sink strainer of the present invention.

Referring to FIG. 6, another embodiment of the present strainer 10 is shown. In this embodiment the strainer 10 is devoid of a post or similar article. Removal of the strainer 10 from a sink drain opening, where quickly fluid can create a substantial vacuum, may be made more difficult without the post, but manufacture of the resulting strainer 10 could be much less expensive. Inversion of the strainer 10 would be accomplished by a user pushing on the second surface 19 of the strainer portion.

The annular flange 14 of the strainer 10 helps to secure the strainer 10 within a desired sink drain opening (not shown) by engaging a surface of the sink (not shown). The flange 14 preferably has a substantial width to provide such securement. It should be understood, however, that some circumstances may not require the strainer 10 to have a flange of any width or may require only a very small flange width. Further, the material of the flange 14 may be a flexible material, similar to the strainer portion 12, or a rigid material, similar to the preferred material of the post 16. The embodiment of FIG. 1 shows a flange 14 comprised of a layer 22 of flexible or rigid plastic material and an outer ring 24 made of a suitable metal.

Figure 7:
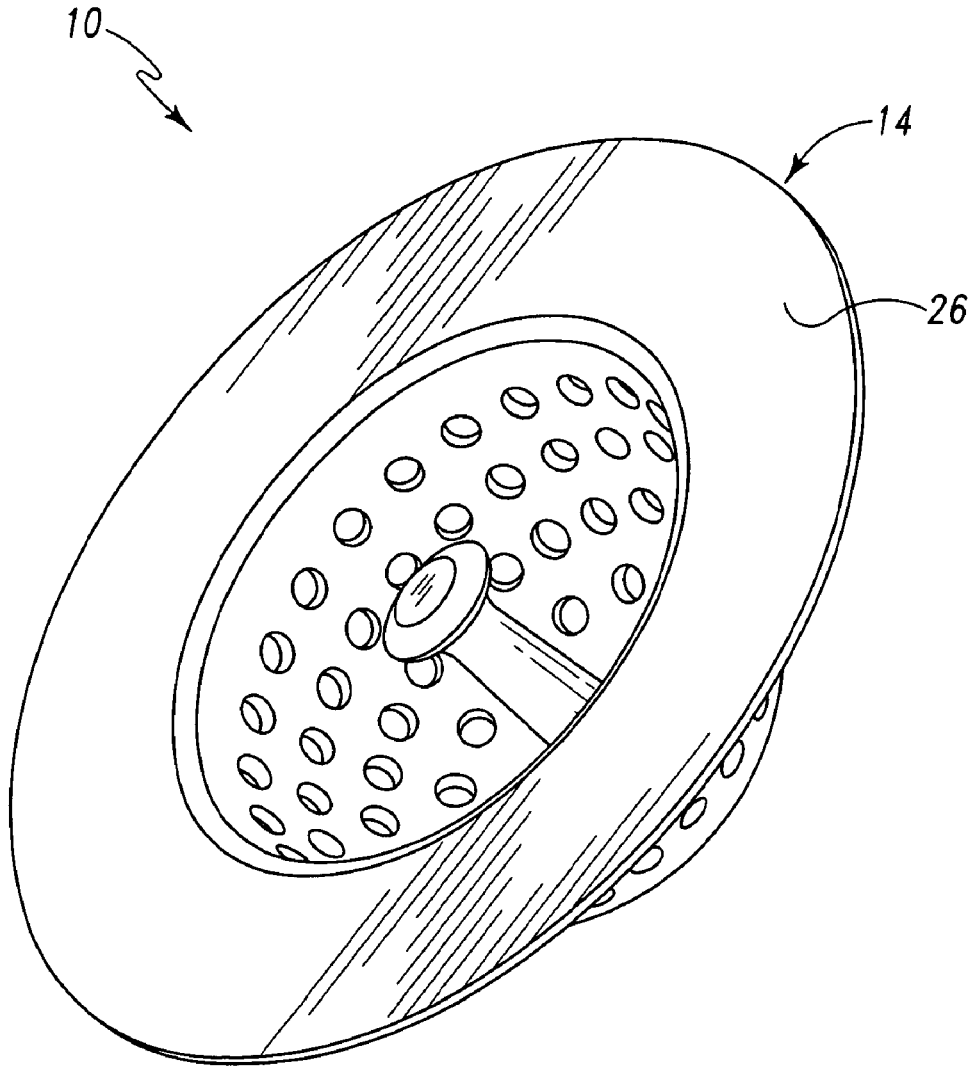
FIG. 7 is a perspective view of a third embodiment of the sink strainer of the present invention.
Figure 8:
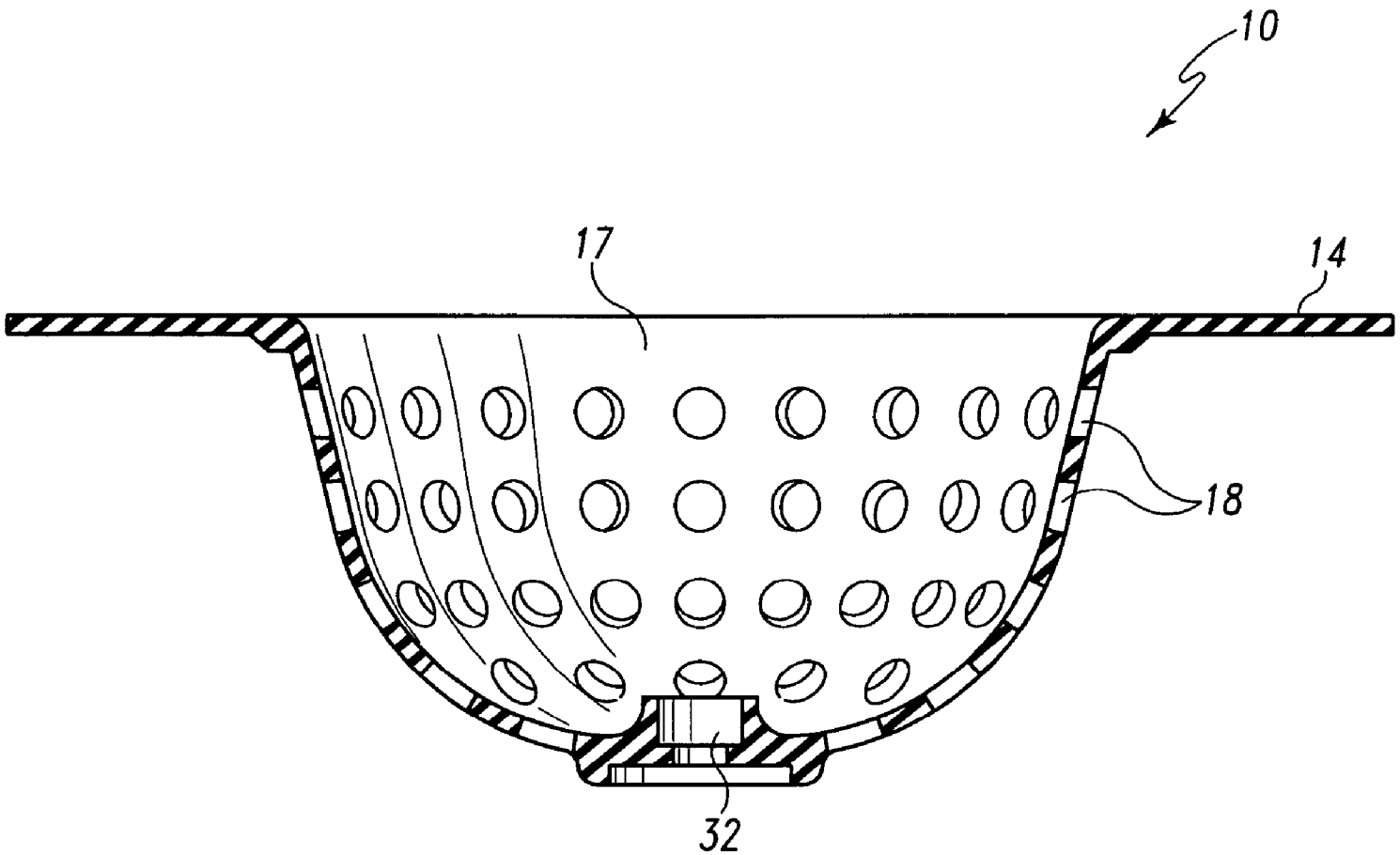
FIG. 8 is a cross-section of the embodiment of FIG. 7.
Figure 9:
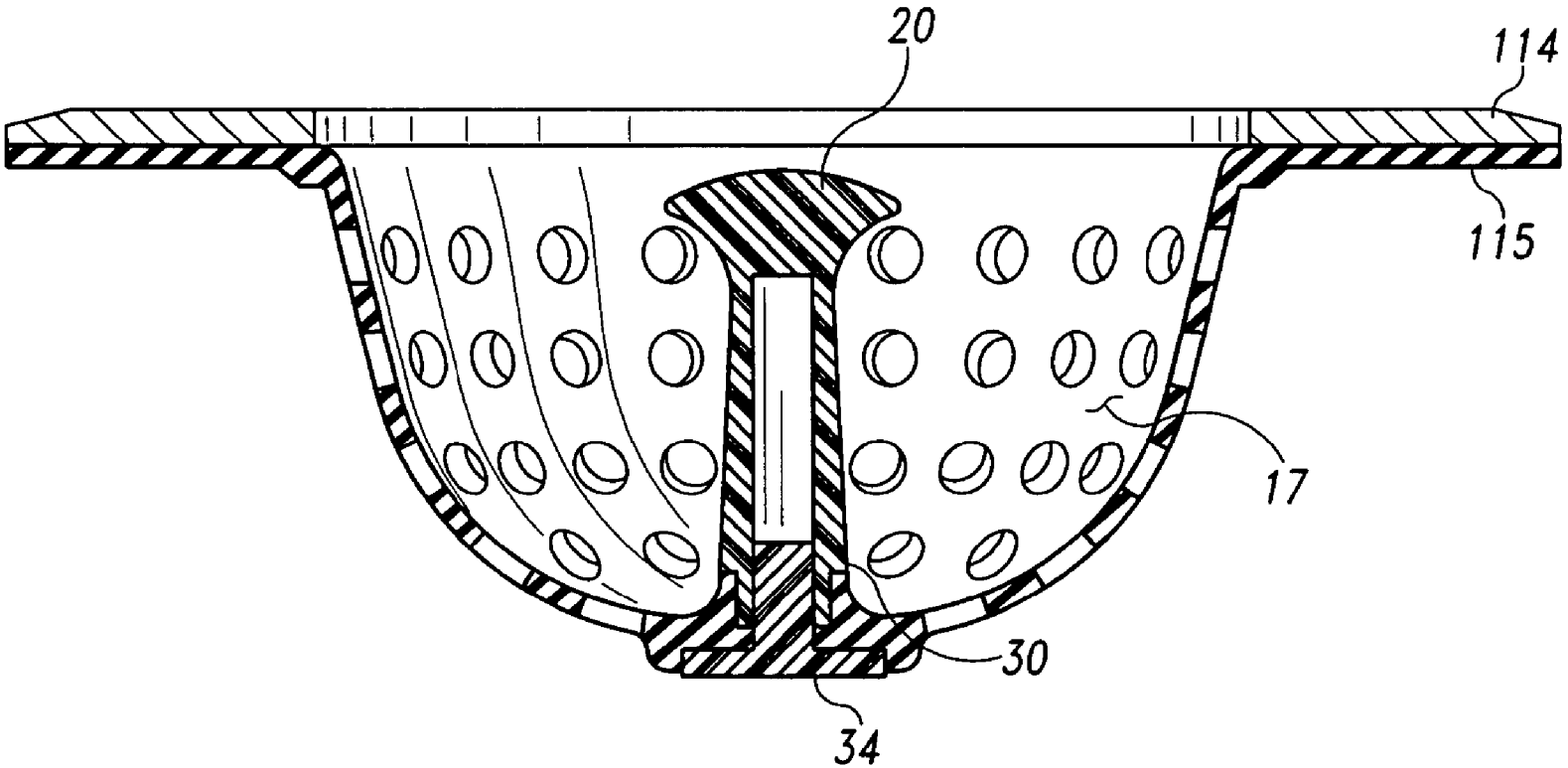
FIG. 9 is a cross-section of a fourth embodiment of the sink strainer of the present invention.

FIGS. 7, 8 and 9 illustrate different embodiments of the invention. FIG. 7 shows an embodiment similar to FIG. 1, except that the flange 14 is comprised of a solid metal ring 26 affixed to the upper edge of the strainer portion 12 by any known means. FIG. 8 shows the cross-section of a strainer 10 having a flange 14 comprised of the same material as, and integral to the strainer portion 12. FIG. 8, as well as FIG. 9, also illustrates the possible removal of the center post, as it might be attached to the strainer portion 12 of the strainer 10. A tubular portion 30 of the rigid post member 16 fits within an opening 32 of the strainer portion 12 and is held in place by fastener 34 from the second surface 19. FIG. 9 illustrates an embodiment having a rigid flange member 114 affixed to a flexible flange member 115, which is molded of material identical to that of the strainer portion 12. These and other variations can be made to the components of the invention while still achieving the intended goals of the flexible strainer 10.

In use, the strainer 10 of FIGS. 1-5 is placed within a sink drain opening (not shown) of a sink (not shown), with the concave first surface 17 and post 16 of the strainer portion 12 facing upwards. As fluid is added to the sink, such as, for example, by running a faucet, the fluid is strained for solid material exceeding the aperture size of the strainer portion, while passing through the strainer 10. At any point during this process, the strainer 10 may be removed from the drain opening and, by inverting the strainer portion as illustrated in FIG. 5, the entrained solids can be properly discarded in, for example, a waste can. The strainer 10 can then be returned to its original configuration and placed back into the sink drain opening or away for storage.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

The invention claimed is:

1. A sink strainer, comprising:

a substantially flat flange having an inner circumference; and a flexible cup-shaped body having a periphery coupled to the inner circumference of the flange; the body being axially movable between an inverted position and a non-inverted position relative to the flange and to permit flow of water through the strainer and into a sink drain opening below the strainer in both the inverted and non-inverted positions.

2. The sink strainer of claim 1, wherein the flange is a flexible flange having a sink engaging surface.

3. The sink strainer of claim 1, wherein the flange is a rigid flange having a sink engaging surface.

4. The sink strainer of claim 1, wherein the body includes a plurality of apertures adapted to allow fluid to pass therethrough while retaining material entrained within the fluid when the body is in the non-inverted position and allowing removal of the material retained in the apertures when the body is in the inverted position.

5. The sink strainer of claim 1, wherein the flange has a width adapted to engage a surface of a sink.

6. The sink strainer of claim 1, wherein the flange has an outside diameter of about 1.5 times an inside diameter of the flange.

7. The sink strainer of claim 1, wherein the flange includes:

a flexible flange member forming a bottom surface of the flange; and a rigid flange member coupled to the flexible flange member, the rigid flange member forming a top surface of the flange.

8. The sink strainer of claim 1, wherein the flange is monolithically formed with the body.

9. The sink strainer of claim 1, wherein the flange is constructed of a metal material.

10. The sink strainer of claim 1, wherein the flange is constructed of a plastic material.

11. The sink strainer of claim 1, wherein the flange is constructed of an elastomeric material.

12. The sink strainer of claim 1, further comprising an upstanding member coupled to the body distal to the periphery, wherein the flange and the upstanding member are constructed of the same material.

13. The sink strainer of claim 11, wherein the body is constructed of a same elastomeric material as the flange.

14. The sink strainer of claim 1, further comprising an upstanding member coupled to the body distal to the periphery, wherein the upstanding member includes a post attached to a center portion of the body.

15. The sink strainer of claim 14, wherein the post has a length sufficient to permit access when the body is displaced in the non-inverted position and is substantially filled with retained material.

16. The sink strainer of claim 15, wherein the post extends to a height coinciding with a sink-engaging surface of the flange.

17. The sink strainer of claim 1, further comprising an upstanding member distal the periphery and removable from the body.

18. The sink strainer of claim 17, wherein the flange, the upstanding member and the body are monolithically formed.

19. The sink strainer of claim 17, wherein the upstanding member and the body are monolithically formed.

20. A sink strainer comprising:

a flange having an inner circumference;

a flexible cup-shaped body having a periphery coupled to the inner circumference and further having a plurality of apertures, the body being adapted to be axially movable between a non-inverted position and an inverted position relative to the flange, the flexible body extending below the flange in the non-inverted position and extending above the flange in the inverted position, the body retaining material entrained within the fluid in the non-inverted position;

the body adapted to permit the flow of water through the strainer and into a drain of a sink in both the inverted position and the non-inverted position.

21. A sink strainer, comprising:

a flange having an inner circumference; and a cup-shaped body having a periphery coupled to the inner circumference and further having a plurality of apertures, the body being axially movable relative to the flange between first and second positions, wherein the flange includes a first flange member forming a sink engaging surface of the flange and a second flange member forming a top surface of the flange, the first flange member being constructed of a material more flexible than a material of the second flange member.

22. The sink strainer of claim 20, wherein the flange includes a first flange member forming a sink engaging surface of the flange and a second flange member forming a top surface of the flange, the first flange member being constructed of a material more flexible than a material of the second flange member.

23. The sink strainer of claim 21, wherein a lower surface of the body is positioned below the substantially flat flange in the first position and the lower surface of the body is positioned higher in the second position than in the first position.

* * * * *

UNITED STATES PATENT AND TRADEMARK OFFICE

CERTIFICATE OF CORRECTION

PATENT NO. : 8,117,685 B2
APPLICATION NO. : 12/903811
DATED : February 21, 2012
INVENTOR(S) : Juan Escobar et al.

It is certified that error appears in the above-identified patent and that said Letters Patent is hereby corrected as shown below:

Column 4, line 28, (claim 6, line 1) delete “claim 1” and insert --claim 5--.

Signed and Sealed this
Twenty-fourth Day of April, 2012

David J. Kappos

David J. Kappos
*Director of the United States Patent and Trademark Office*